US005915636A

United States Patent [19]

Caballero

[11] Patent Number: 5,915,636

[45] Date of Patent: Jun. 29, 1999

[54] PARTICULATING MILL AND METHOD FOR REDUCING PARTICLE SIZE OF SOLID MATERIALS

[75] Inventor: Joe L. Caballero, Shallowwater, Tex.

[73] Assignee: Meda-Works, Inc., Lubbock, Tex.

[21] Appl. No.: 08/513,363

[22] Filed: Aug. 10, 1995

[51] Int. Cl.[6] ..... B02C 13/28

[52] U.S. Cl. ..... 241/73; 241/189.1; 241/190; 241/194; 241/236

[58] Field of Search ..... 241/606, 73, 26, 241/187, 189.1, 190, 236, 194

[56] References Cited

U.S. PATENT DOCUMENTS

| | | | |
|---|---|---|---|
| 3,389,864 | 6/1968 | Topinka . | |
| 3,396,914 | 8/1968 | Liebman | 241/187 X |
| 3,929,295 | 12/1975 | Montalbano . | |
| 4,619,409 | 10/1986 | Harper et al. . | |
| 4,809,915 | 3/1989 | Koffsky et al. . | |
| 4,889,290 | 12/1989 | Koffsky et al. . | |
| 5,054,696 | 10/1991 | Mennel et al. . | |
| 5,150,843 | 9/1992 | Miller et al. . | |
| 5,277,869 | 1/1994 | Glazer et al. . | |
| 5,413,286 | 5/1995 | Bateman | 241/194 |
| 5,503,339 | 4/1996 | Doppstadt | 241/187 X |

FOREIGN PATENT DOCUMENTS

| | | | |
|---|---|---|---|
| 2583656 | 12/1986 | France | 241/187 |
| 196537 | 8/1967 | U.S.S.R. | 241/190 |
| 238117 | 8/1925 | United Kingdom | 241/187 |

*Primary Examiner*—Mark Rosenbaum
*Attorney, Agent, or Firm*—Royston, Rayzor, Vickery, Novak & Druce, L.L.P.

[57] ABSTRACT

A mill for reducing solid material into smaller pieces including a hammer member oriented for rotation and having a plurality of hammer pins coupled to the hammer member for fragmenting solid material. A cutting member is oriented for rotation and having a plurality of blades for cutting solid material. The hammer member is positioned proximate to the cutting member so that solid material processed through the mill is broken into smaller pieces. The hammer member has a plurality of blades that are positioned, one each between adjacent hammer pins. The hammer member has a longitudinal axis about which the hammer member rotates. The cutting member has a longitudinal axis about which the cutting member rotates. The hammer member and the cutting member each having substantially cylindrical peripheries; and each of the peripheries includes a plurality of circumferentially aligned ridges and recesses. The longitudinal axis of the hammer member is parallelly oriented to the longitudinal axis of the cutting member and distanced therefrom so that the peripheries overlap. In this way, the ridges of the hammer member interweave with the recesses of the cutting member and the ridges of the cutting member interweave with the recesses of the hammer member.

10 Claims, 3 Drawing Sheets

PARTICULATING MILL AND METHOD FOR REDUCING PARTICLE SIZE OF SOLID MATERIALS

FIELD OF THE INVENTION

This invention relates to devices that are used to reduce the particulate size of waste before its final disposal. More particularly, it relates to devices having capabilities to simultaneously fragment rigid waste and shred pliable waste.

BACKGROUND OF THE INVENTION

Mills and other fragmenting devices are commonly known to be used to grind and pulverize solid matter. For various reasons, any number of different types of solid material may require particle size reduction. Among those different types of material are agricultural products such as wheat and corn. Of equal importance, however, is waste matter that must be reduced in size before being finally disposed. Medical waste must often times be reduced before disposal to prevent it from attracting attention or presenting a hazard to those that must handle it. Furthermore, it protects the public that may subsequently contact the waste, either intentionally, or inadvertently.

Depending upon the nature of the waste to be reduced, hammer mills using hammer pins have been used to pulverize hard materials thereby making the materials easier to dispose. Other mills have utilized a series of saw blades to shred more pliable materials such as fabric, paper, and plastic. Heretofore, the two have not been combined.

Because of increased public concern regarding communicable diseases, statutes and administrative rules and regulations have issued that require hospitals that dispose of waste in landfills to process it into an unrecognizable form prior to public disposal. One method is to use a mill to process the waste. U.S. patents that have issued concerning mills used for processing hospital waste include U.S. Pat. No. 3,389,864 to Topinka for Waste Disposal Unit and U.S. Pat. No. 3,929,295 to Montalbano for Apparatus For Destroying Syringes and Like Articles.

U.S. Pat. No. 3,389,864 includes the disclosure of a waste disposal unit designed to dispose of fabrics. The waste disposal unit includes a housing. A pair of cylindrical rollers with a series of blades extending from their respective circumferences is positioned inside the housing. Adjacent to each cylindrical roller is a raking bar. The raking bar clears debris that accumulates on the cylindrical roller. Each cylindrical roller is positioned so that a passageway exists between the two rollers.

U.S. Pat. No. 3,929,295 includes disclosure of a waste disposal apparatus unit for syringes contained within a housing. Attached to the top of the housing is a storage unit used to hold syringes that are about to be destroyed. Inside the housing is an elongated bar having several circular saws positioned down the length of the elongated bar. A series of stationary blades are placed interstitially between the circular saws separating one from the others. As syringes are fed into the apparatus, a chute guides the syringes to the rear of the saws. The saws rotate thereby catching and propelling the syringe against the series of stationary blades. As a result, the syringes emerge from the front side of the saw in a dismembered state.

Examining these devices reveals significant shortcomings when the simultaneous reduction of commingled rigid and pliable waste is contemplated. Because known disposal units have specialized functions with respect to rigid and pliable solid waste, the waste must be separated prior to disposal. Separating waste requires extra work, which translates into additional time and money. Furthermore, space must be allocated for storing the segregated waste prior to disposal.

In the more particular instance of medical waste, workers may be exposed to such incurable and life-threatening diseases as Acquired Immunity Deficiency Syndrome (AIDS) and hepatitis during the pre-sorting process. In the specific example of syringe disposal, most devices require manual loading. The manual loading process consumes inordinate amounts of time and directly and repeatedly exposes the disposal worker handling the syringes to the risk of puncturing themselves with contaminated needles.

A need exists for a waste disposal apparatus for hospitals and others that can dispose of not only pliable materials, but hard objects as well. In the example of a hospital, such a device should be able to handle large loads of unsegregated hospital waste and process it in such a manner that the waste is unrecognizable in a land fill. Still further, a disposal device is needed that can reduce moist and liquid soaked materials without binding or clogging. Further yet, the device should minimize the workers' exposure to the waste until it is processed into a innocuous form. Not only are complete disposal systems sought, but improved components for achieving the various size reductions are also needed.

SUMMARY OF THE INVENTION

This invention includes components that have been invented and selected for their individual and combined benefits and superior performance as a milling system. The system includes multiple components that individually and singularly have new and novel features in and of themselves. Each of the individual components, however, work in association with, and are optimally mated to the others. Together, they yield a milling system that has superior collective effectiveness in fragmenting and shredding solid waste, regardless of whether the waste is dry, moist, or fluid soaked.

These features have been found to be highly sought after in the medical field, and particularly among hospitals and clinics that must dispose of large amounts of waste that may constitute a bio-hazard. Compounding the hospital's disposal problem is that their waste is produced in different forms. The content of the solid waste may vary widely. At one end of the spectrum are materials that are soft, pliable and susceptible to destruction by tearing or shredding forces; examples include cotton pads, paper and plastic packaging and paper tissue used in patient treatment. At the opposite end of the spectrum are metal components of administering devices, such as the needles of syringes. It may also include more substantial items such as damaged surgical instruments and worn out equipment. In between the two extremes lie such items as linens and scrubs at the pliable end and discarded cleaning supplies such as mop heads and scrub brushes at the more rigid end.

Further complication experienced by the hospitals is that the refuse is often delivered for disposal in varying degrees of wetness. This obviously affects the materials' characteristics and performance within a disposing device. In the case of the above examples, the linens may be soaked or damp, depending on what they were most recently used for before being discarded. Similarly, the items such as the mop head will most likely be thoroughly soaked because they will have been immediately discarded when it was determined during their use in cleaning fluid that they had lost their effectiveness. Furthermore, because of the hospital's practice of sterilizing the waste prior to reducing its size, the waste will always be at least moist. This results from microwaving the waste to raise its temperature, and then injecting water that turns to steam and sterilizes the waste. In the process, however, the waste picks up an appreciable amount of moisture. The fact that the waste is moisture laden presents several problems that must be overcome by the disposal device's design. One problem is that the material tends to stick together when moist and present more of a clogging problem than when dry. Still further, the wet material tends to stick to the components of the reducing machine and potentially cause it to cease-up due to the binding effects of waste buildup.

There are also problems associated with the combination of pliable and rigid material. The rigid matter will not necessarily feed into the mechanisms for shredding the pliable material since most rely upon a grabbing action that requires at least some degree of penetration, entanglement or piercing of the pliable material. Conversely, the pliable material will not be affected by the devices that rely on impacts and shearing forces to break down the brittle pieces.

The present invention overcomes these detriments by combining both mechanisms and processes for disposal of rigid and pliable waste. It should be understood that the rotatable elements are driven rapidly so that when they strike an object, it is a sharp blow, and with great impact. Furthermore, multiple locations are provided at which rigid and semi-rigid waste material may be reduced in size either upon impact, or as a result of shearing forces applied by opposingly moving parts having relatively narrow clearances therebetween. The hammer member has multiple protrusions from its generally cylindrical surface. Among the protrusions are projecting teeth from the blades, and hammer pins that are pivotally connected to the hammer member. The pivot permits a swinging action within the body of the hammer member and across a limited distance of the member's surface. As a result, when waste is directed into contact with the hammer member it is initially struck with great force. If the material is rigid, it may be fragmented upon impact, but at least will be propelled into the cutting member and ultimately through the processing grid at the intersection of the hammer member and cutting member. In the instance of pliable material contacting the hammer member, it will usually become entangled on the jagged surface and dragged into the processing grid.

Rigid material may be further broken upon contact with the hammer mill if it is caught between a swinging hammer pin and an adjacent blade. An additional and more likely possibility is that the hard piece of waste will be broken up when caught between the opposingly moving parts of the hammer and cutting members at their intersection. It may also fragment if caught between the swinging hammer pin and the shaft of the cutting member. Another point of fragmenting contact may be supplied at the comb of the cutting member. Smaller pieces of debris may be propelled against the comb by the cutting member, or broken if caught between a blade of the cutting member and finger of the comb. After feeding through the grid of the component's intersection, brittle material may also be fragmentized when propelled against the fragmenting bars at a lower portion of the hammer member.

The pliable material is primarily processed in the interweaved intersection of the hammer and cutting members. Both members carry toothed blades that entangle the pliable material and effectively pull it apart. It is the pliable material that is most likely to foul the machine, therefore the sweeping action of the interweaved components, together with the comb fingers, dislodge the material and prevents binding of the moving parts. Further, the sweeping action assures that the waste continues to be processed into sufficiently small pieces to pass through the screen and be collected for final disposal.

In one embodiment, the hammer member takes the form of a particlizer having unique features that allow it to efficiently process solid waste. Therein, the particlizer includes a series of adjacently oriented circular blades that are rotationally off-set so that the adjacent teeth of the blade are not aligned along the longitudinal length of the particlizer. By off-setting the teeth, the jagged nature of the particlizer's outer surface is enhanced. This increases the frequency of protrusions off of the particlizer's body for striking hard waste and potentially fragmenting it. It also presents more locations upon which pliable matter may become entangled and pulled apart, or shredded.

Referring now to specific embodiments of the invention, additional benefits and advantageous features will be appreciated. One embodiment of the invention is a mill for reducing solid material into smaller pieces. The mill includes a hammer member oriented for rotation and having a plurality of hammer pins coupled to the hammer member for fragmenting solid material. There is also a cutting member oriented for rotation and having a plurality of blades for cutting solid material. The hammer member is positioned proximate to the cutting member so that solid material processed through the mill is broken into smaller pieces.

The hammer member has a plurality of blades that are positioned, one each between adjacent hammer pins.

The hammer member has a longitudinal axis about which the hammer member rotates. The cutting member has a longitudinal axis about which the cutting member rotates. The hammer member and the cutting member each having substantially cylindrical peripheries; and each of the peripheries includes a plurality of circumferentially aligned ridges and recesses. The longitudinal axis of the hammer member is parallelly oriented to the longitudinal axis of the cutting member and distanced therefrom so that the peripheries overlap. In this way, the ridges of the hammer member interweave with the recesses of the cutting member and the ridges of the cutting member interweave with the recesses of the hammer member.

The ridges and the recesses interweave with narrow clearances therebetween so that brittle or rigid pieces of solid material positioned across the narrow clearances are fragmented by opposed relative motion of the hammer member and the cutting member at the interweaved peripheries.

At least one fragmenting bar is positioned proximate to the hammer member so that solid material projected from the hammer member is further fragmented upon striking the fragmenting bar. Also, the fragmenting bar is coupled to an adjustment scroll for maintaining a substantially uniform clearance between the fragmenting bar and the hammer member.

A hopper is positioned close to, or proximate to the hammer member for directing solid material into the periphery of the hammer member.

The cutting member has a rotational axis and a blade combing member positioned substantially parallel to the rotational axis of the cutting member for sweeping solid material from the cutting member.

The blades are regularly spaced along a length of the cutting member and the blade combing member has a plurality of fingers wherein at least a portion of the fingers are positioned between adjacent blades.

The hammer pins are regularly spaced to form generally circumferential rows of hammer pins around the hammer member that are regularly spaced along a length of the hammer member.

A screen is positioned proximate to the hammer member for selectively permitting solid waste to be dispensed from the mill.

A motor is engaged with the cutting member and the hammer member for rotating both members.

The cutting member and the hammer member are commonly driven in a like rotational direction thereby providing opposing movement where the cutting member interweaves with the hammer member.

In another embodiment, a mill for reducing solid material into smaller pieces is provided and includes a first cutting member oriented for rotation and having a plurality of blades. There is also a second cutting member oriented for rotation and having a plurality of blades. The blades of the first cutting member are sweepingly engaged with the blades of the second cutting member for interweaved rotation therewith so that solid material processed through the mill is cut into smaller pieces.

The second cutting member further comprises hammer pins that are spaced along a length of the second cutting member so that at least a portion of the blades of the first cutting member are interstitially located between the hammer pins of the second cutting member.

In other respects, this embodiment is similar to that described hereinabove.

In yet another embodiment, a method for reducing solid material into smaller pieces is provided. The method includes positioning a first rotatable cutting member having a plurality of blades adjacent to a second rotatable cutting member having a plurality of blades and a plurality of hammer pins. The plurality of blades of the first rotatable cutting member are interweaved with the blades and hammer pins of the second rotatable cutting member.

Additionally, the blades of the first rotatable cutting member are oriented along a length of the first rotatable cutting member and a combing member having a plurality of fingers substantially parallel to a rotational axis of the first rotatable cutting member is positioned so that the fingers are interstitially positioned between blades of the first rotatable cutting member.

The method also includes orientating the hammer pins to form substantially circumferential rows around the second rotatable cutting member and orientating the rows into regularly spaced intervals along a length of the second rotatable cutting member.

A motor is provided for rotating the first rotatable cutting member and the second rotatable cutting member.

In yet another embodiment, the invention includes a particlizer for particlizing solid material. The particlizer includes a first particlizer body having a substantially cylindrical shape and a central longitudinal axis about which the first particlizer body is rotatable. The first particlizer body includes a plurality of saw-toothed blades; each blade having a substantially circular periphery. Each of the blades has a plurality of cutting teeth that are equally spaced about the periphery of the blades thereby forming a circumferential series of cutting teeth at the circular periphery. The plurality of blades is positioned in longitudinal series so that the peripheries of the blades collectively establish the substantially cylindrical shape of the first particlizer body. Adjacent circular blades of the first particlizer body are off-set so that the cutting teeth of adjacent blades are staggered. This presents a jagged surface at a periphery of the first particlizer body for engaging solid material and reducing the material into smaller pieces when the first particlizer body is rapidly rotated.

Each tooth of the series of cutting teeth has a width measured along the central longitudinal axis of the first particlizer body. Each tooth of the series of cutting teeth has a radial recess therein, the recess has a width that is measured along the longitudinal axis of the first particlizer body. The width of each recess is narrower than the width of each cutting tooth and each of the recesses is circumferentially aligned so that an intermittent circumferential groove is established at a periphery of the saw-toothed blade.

A second particlizer body has a generally cylindrical shape and a central longitudinal axis about which the second particlizer body is rotatable. The second particlizer body includes a plurality of saw-toothed blades. Each blade has a substantially circular periphery. Each of the blades of the second particlizer body has a plurality of cutting teeth that are equally spaced about the periphery of the blades thereby forming a circumferential series of cutting teeth about the circular periphery of the second particlizer body. Each tooth of the series of cutting teeth of the second particlizer body has a width measured along the central longitudinal axis of the second particlizer body. The width of each tooth of the second particlizer body is narrower than the width of each recess in the cutting teeth of the first particlizer body.

The central longitudinal axis of the first particlizer body is positioned relative to the central longitudinal axis of the second particlizer body so that distal radial ends of the teeth of the second particlizer body are located within the intermittent circumferential groove established at the periphery of the saw-toothed blade of the first particlizer body.

At least one winged spacer is positioned between adjacent saw-toothed blades of the first particlizer body. The winged spacer has at least two wings and each wing has a semicircular periphery that is saw-toothed.

Each winged spacer includes at least one hammer pin that is located between adjacent wings and the hammer pin is journalled to the first particlizer body for pivotal movement between the adjacent wings.

The second particlizing body has at least one spacing shaft positioned between adjacent saw-toothed blades of the second particlizing body. The spacing shaft has a cylindrical periphery located radially inward from the blades' peripheries. The hammer pin has a length sufficient to extend a distal end of the hammer pin radially beyond the winged spacer and the saw-toothed blades of the first particlizer body. The first and second particlizer bodies are relatively oriented so that a minimal clearance space is provided between the spacing shaft of the second particlizer body and the distal end of the hammer pin when the hammer pin is full extended radially outward from the longitudinal axis of the first particlizer body.

A comb is provided for removing debris from the second particlizing body. The comb has at least one finger extending between adjacent saw-toothed blades of the second particlizing body with a minimum clearance between the finger and the adjacent blades.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

Figure 9:
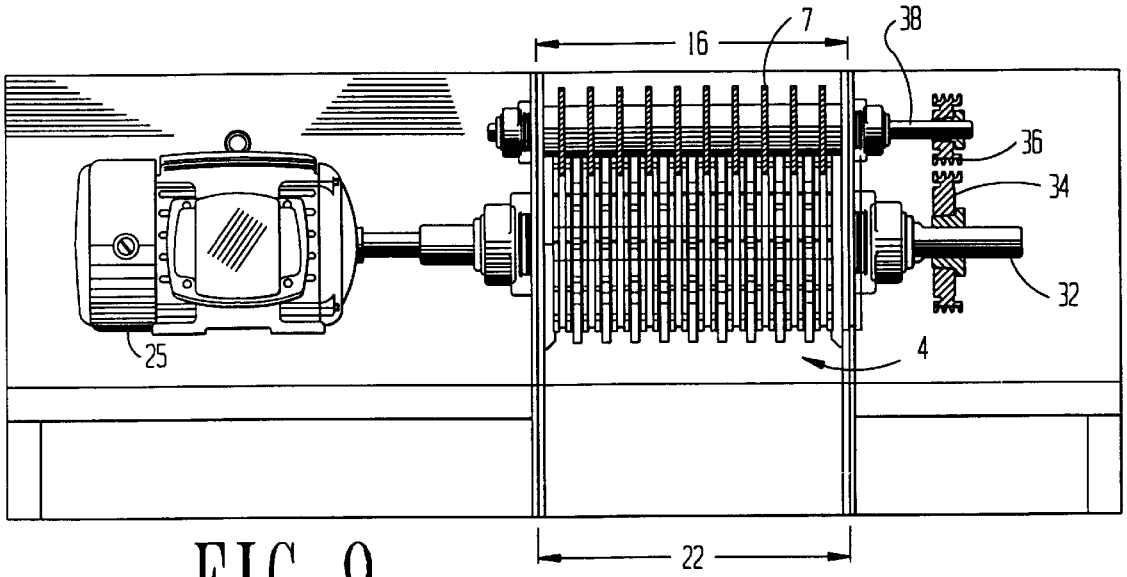
FIG. 9 is a side view of the motor and mill connected together for driven rotation.

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Certain terminology will be used in the following description for convenience and reference only and will not be limiting. For example, the words "rightwardly", "leftwardly", "upwardly" and "downwardly" will refer to directions in the drawings to which reference is made. "Upstream" and "downstream" may be used to identify directions relative to the flow of solid waste through the fragmenting and shredding device. The words "inwardly" and "outwardly" refer to directions toward and away from, respectively, the geometric center of the structure being referred to. This terminology includes these words, specifically mentioned derivatives thereof, and words of similar import.

Furthermore, in the claims, elements may be recited as being "coupled"; when such terminology is used, it is anticipated that the elements may be connected together in such a way that there may be other components interstitially located between the connected elements or that the elements may be connected in fixed or movable relation one to the other.

Figure 1:
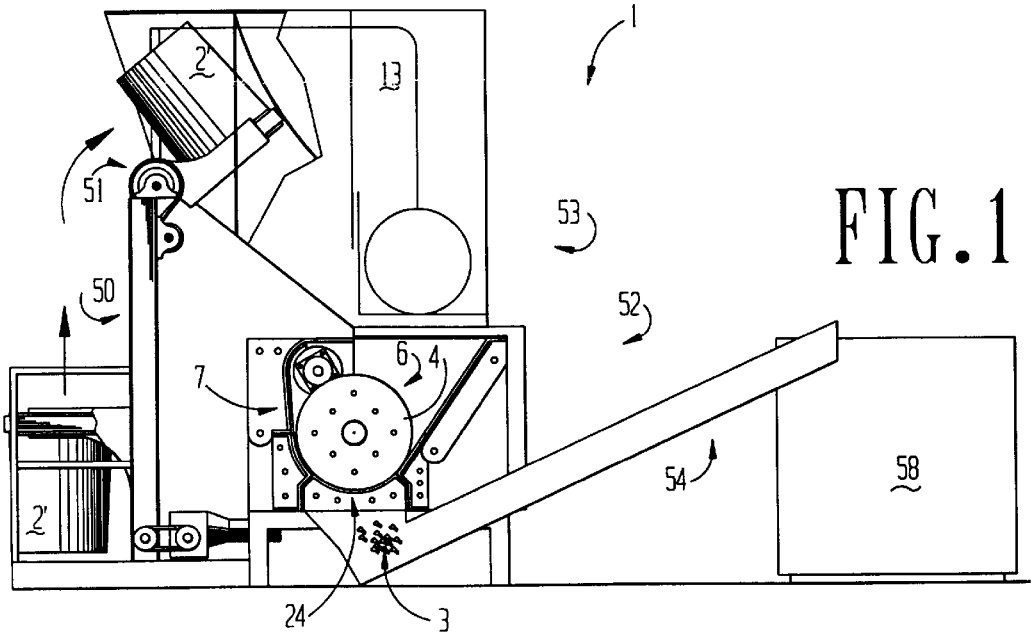
FIG. 1 is a side view of one embodiment of the invention.

Referring to FIG. 1, a mill or particlizer 1 for shredding and fragmenting solid material 2 is illustrated. As shown, the mill 1 is being used to process medical waste 2, together with the waste's transporting container 2'. It should be pointed out that the mill 1 can be used in applications outside of the medical field, such as processing cotton burrs, ears of corn, tires, or other waste. As shown in FIG. 1, the mill 1 includes a lift 50, hopper 13, housing 52, conveyance system 54, and dump bin 58. In this type of application, a trash can 2' or other suitable container is filled with medical waste 2 such as syringes, plastic packaging, cotton paper, surgical gowns, other liners, and mop heads. Prior to being fed into the mill 1, the medical waste 2 is typically sterilized. Most often, this is accomplished by heating the waste 2 in a microwave. Next, water is injected into the microwave with the waste 2 and container 2' where it vaporizes into steam. The waste 2 is treated at a pressure of 21 pounds per square inch (psi) and at a temperature of 275 degrees Fahrenheit for 30 minutes. After the sterilization process is completed, the waste 2 is ready to be reduced or particularized. It is contemplated that commercially available trash cans may be utilized as the waste containers provided they can withstand the treatment environment.

The sterilized waste 2 is transported to the lift 50 that raises the waste container 2' upward until the container 2' reaches an inverting roller 51. If the container 2' is damaged in the microwave process, then it maybe processed along with the waste 2 as shown by FIG. 1. Alternatively, the container 2' is dumped and then reused. In the case of the container 2' being disposed of, the roller 51 inverts the container 2', together with the waste 2, into the hopper 13. The hopper 13 then guides the container 2' toward an opening in the housing 52. As the container 2' is moving toward the top of the lift 50, a ram 53 is being lowered. As the waste reaches the base of the hopper 13 and enters the particalizing portion of the mill, the ram 53 urges the waste 2 into the shredding and fragmenting members and then closes off the entrance. In this way, the ram 53 prevents the waste 2 from being thrown from the housing 52 and back up into the hopper 13. As the lift 50 is lowered, the ram 53 raises upward. Like the lift 50, the ram 53 is raised by winches and allowed to lower under its own weight.

In the housing, the container 2' is processed by a hammer member 4 and cutting member 7. The hammer member 4 is also referred to as a second cutting member, second rotatable cutting member, or first particlizer body, and the cutting member 7 is also referred to as a first cutting member, first rotatable cutting member or second particlizer body. The hammer member 4 and cutting member 7 fragment and shred the waste 2 into smaller sized pieces 3 that will fall through a screen 24 onto the conveyance system 54. The conveyance system 54 will carry the waste 2 into the dump bin 58. In one embodiment, the conveyance system 54 is an auger conveyor. Alternatively, the conveyance system 54 is a continuous belt.

The waste 2 can be fed into the mill 1 continuously. Normally, however, it will be a batch process because of the commonly used means for transporting the waste 2 and sterilizing it.

Figure 2:
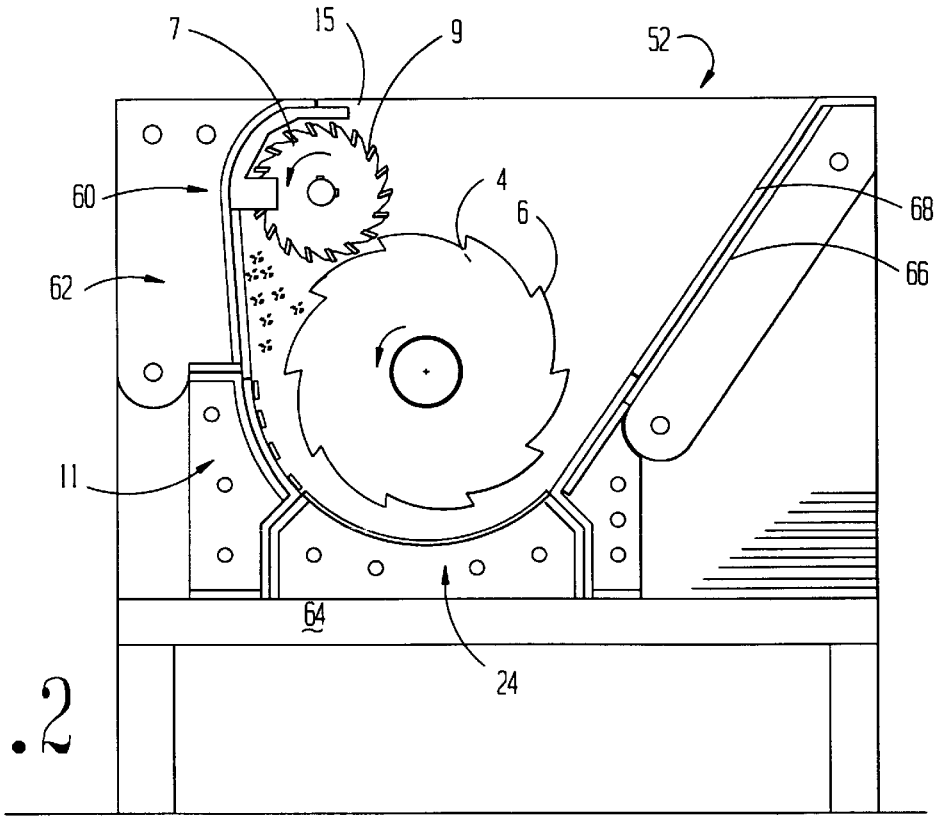
FIG. 2 is a cut-away side view of the invention illustrating the cutting member and hammer member positioned inside of the housing.
Figure 3:
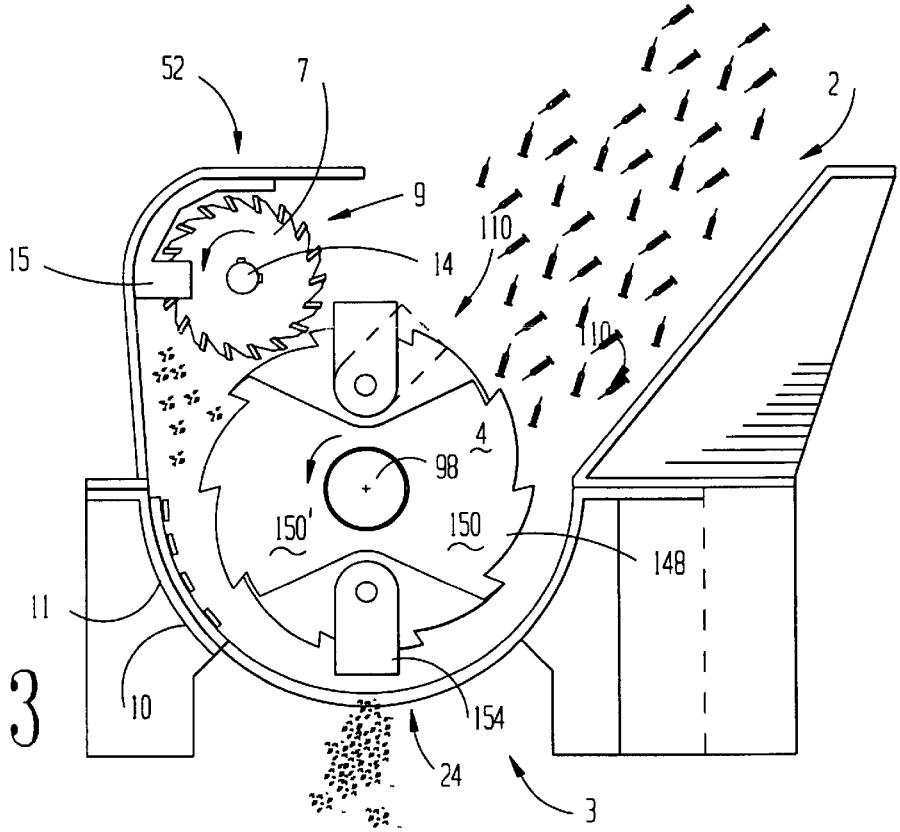
FIG. 3 is a cut-away view of one embodiment of the invention illustrating the cutting member and hammer member fragmenting and shredding waste.
Figure 5:
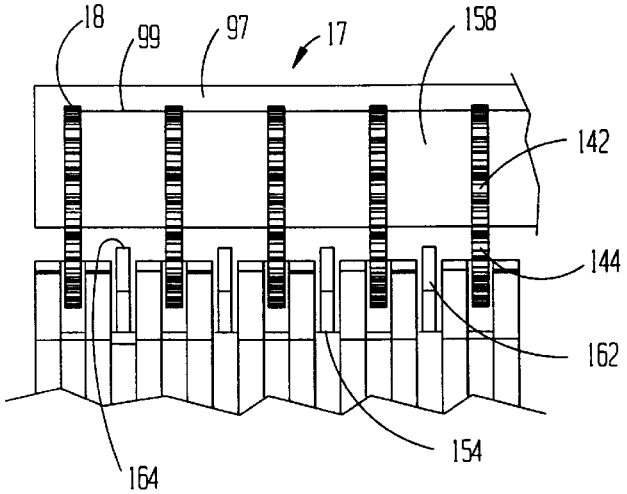
FIG. 5 is a front view taken from the perspective of line 5—5 of FIG. 4 showing an enlarged view of the blades of the cutting member in interweaved engagement with the hammers and blades of the hammer member.

Details of the housing 52 are shown in FIG. 2 and FIG. 3. In FIG. 2, the hammer member 4 and cutting member 7 are shown within the housing 52. Both the hammer member 4 and cutting member 7 have substantially cylindrical peripheries 6 and 9, respectively. A blade combing member 15, also referred to as a combing member or comb, is placed adjacent to the cutting member 7 and above the hammer member 4. The blade combing member 15 is positioned substantially parallel to a rotational axis or central longitudinal axis 14 of the cutting member 7. The blade combing member 15 includes a plurality of fingers 17 as shown by FIG. 5. An adjustment scroll 11 is also located proximate to the hammer member 4 for positioning the screen 24. The housing 52 also includes a first wear plate 60, first access door 62, leg support 64, second access door 66, and second wear plate 68.

FIG. 3 is a cut-away view of the housing 52 showing waste 2 being processed. As the waste 2 enters the housing 52, it falls into the hammer member 4. Because the hammer member 4 is rapidly rotating, some brittle pieces of waste 2 will be fragmented upon this initial impact. In any event, the hammer member 4 thrusts the waste 2 upward toward the cutting member 7. The cutting member 7 aids in shredding and fragmenting the waste 2 as it is projected upward. The cutting member 7 forces the waste 2 into the combing member 15. The waste 2 falls from the comb 15 to the backside of the hammer member 4. The hammer member 4 further fragments the waste 2 by throwing the waste 2 against the fragmenting bars 10. The waste 2 continues to travel downward until it reaches the bottom of the housing 52. If the waste 2 is sufficiently particularized, it passes through the screen 24. If the waste particles are too large to pass through the screen 24, then the hammer member 4 carries the waste 2 back toward the cutting member 7, repeating the process.

As the waste 2 enters the housing 52, the waste 2 will be carried upward and backwards toward the cutting member 7 by the rotational movement of the hammer member 4. The hammer member 4 and cutting member 7 rotate in a like direction 26; that is in the same rotational direction. In this embodiment the rotation is counter-clockwise. In another embodiment, the hammer member 4 and cutting member 7 may be rotated in opposite directions. For example, the cutting member 7 could be rotating clockwise while the hammer member 4 is rotating counter-clockwise. It is preferred, however, that the members be rotated in the same direction with the teeth on blades of each biting forward.

The hammer member 4 is constructed from a series of blades 27 having winged spacers 148 positioned between adjacent blades 108. A plurality of hammer pins 5 is pivotally connected in the spaces between wings 150 and 150' of the spacer 148. The hammer pins 5 are connected on opposing sides of the hammer member 4 as illustrated in FIG. 3 for maintaining balance. Because any number of blades 27 and spacers 148 can be used in constructing the hammer member 4, this feature provides more flexibility to the manufacturer in constructing the mill 1. Furthermore, two or more wings may be utilized in the spacer 148, providing all are equally spaced for balance.

Figure 4:
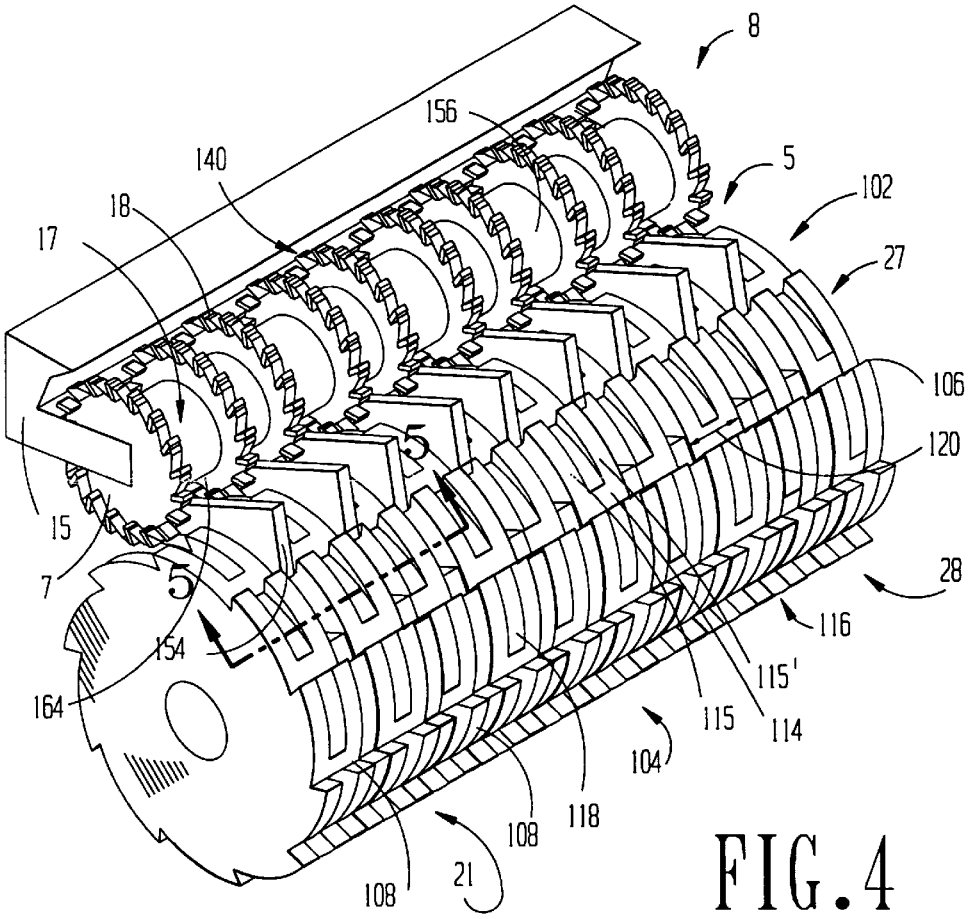
FIG. 4 is a perspective view of the cutting member in interweaved engagement with the hammer member, together with the combing member.

The several blade discs 27 of the hammer member 4 are shown in FIG. 4 as being positioned so that their teeth 102 are longitudinally and linearly aligned across the peripheral surface 6 of the hammer member 4. This configuration forms a longitudinal series of blades 106. Alternatively, the blades 27 are relatively rotated so that the teeth 102 of adjacent blades 108 are not longitudinally and linearly aligned, but instead are off-set thereby establishing a jagged surface 110 at the hammer member's periphery 6.

Figure 7:
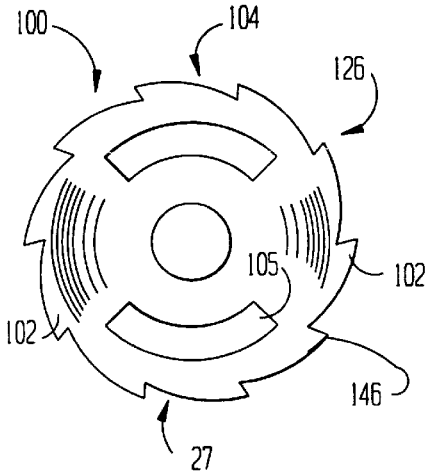
FIG. 7 is a perspective view of a blade of the hammer member.

A single blade 27 of the hammer member 4 is illustrated in FIG. 7 as a perspective view. The blade 27 has a substantially circular periphery 126. Positioned about the periphery 100 is a plurality of cutting teeth 102 arranged in a circumferential series 104. In the illustrated embodiment, a pair of apertures 105 extend through the blade 27. The apertures 105 reduce material costs and the weight of the blade 27. Alternatively, if heavier blades are required for particularizing the waste 2, the blade 27 can be manufactured without apertures 105.

Each tooth 114 of the blade 27 has a width 116. A radial recess 118 is notched out of the tip of each tooth 114. On a given tooth 114, the radial recess 118 divides that tooth into opposite points 115 and 115'. A width 120 of the radial recess 118 is narrower than the width 114 of the blade 27. The radial recesses 118 on blade 27 form an intermittent circumferential groove 124 at the periphery 136 of each blade 27. The circumferential grove 124 is wide enough to accommodate tip portions of the blades 8 of the cutting member 7 that will hereinafter be described.

Figure 6:
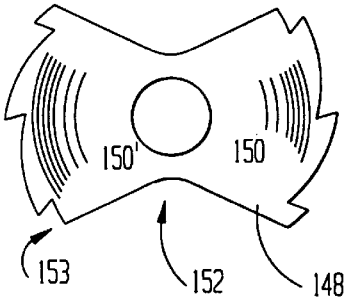
FIG. 6 is a perspective view of a winged spacer.

As previously described, winged spacers 148 are positioned between adjacent blades 108 of the hammer member 4. A single winged spacer 148 is illustrated in FIG. 6. In the illustrated embodiment, the spacer 148 includes a pair of wings 150 and 150'. The wings 150 and 150' each have a semi-circular periphery 152 that is saw-toothed 153. The saw-toothed periphery 152 aids in fragmenting and shredding waste 2.

Referring to FIG. 3, the hammer pins 5 are pivotally connected to the blade 27. The hammer pin 5 pivots back and forth in the angle between the wings 150 and 150' of the spacer 148. This swinging action of the hammer pin 5 aids in fragmenting waste 2 against the sides of the wings 150 and 150'.

As shown in the embodiment of FIG. 4, the hammer pins 5 are arranged into generally circumferential rows 21, where each row is oriented generally perpendicular to the longitudinal axis 98 of the hammer member 4. These rows 21 are regularly spaced or organized into regularly spaced intervals 28 along a length 16 of the hammer member 4. As shown in the embodiment in FIG. 4, the hammer member 4 has nine rows of hammer pins 5. Each row 21 contains two hammer pins 5. A row 21 of hammer pins 5 is positioned between adjacent blades 27.

Figure 8:
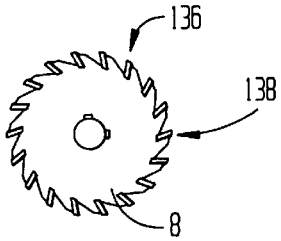
FIG. 8 is a perspective view of a blade of the cutting member.

After the waste 2 is processed by the hammer member 4, it travels upward to the cutting member 7. The cutting member 7 has a plurality of blades 8 regularly spaced along a length 22. The cutting member 7 spins thrusting the waste 2 to the rear of the housing 52. A single blade 8 is illustrated in FIG. 8. The blade 8 includes a plurality of cutting teeth 138 positioned about a substantially circular periphery 136. The blades 8 are regularly spaced across the cutting member 7 forming a circumferential series 140 of cutting teeth 138 about its periphery 9. In the embodiment shown in FIG. 4, ten blades 8 are regularly spaced along the length 22 of the cutting member 7. The blades 8 are constructed from T-1 steel.

Each tooth 142 of the blade 8 has a width 144. The width 114 of the tooth 142 is narrower than the width 120 of the radial recess 118. Distal circumferential ends 146 of the teeth 138 spin in the groove 124 of the hammer member 4. As the cutting member 7 and hammer member 4 spin, the blade 8 spins removing waste 2 from between the hammer pins 5. Also the points 115 and 115' of the tooth 114 of the hammer member 4 sweep waste 2 from between blades 8 of the cutting member 7. This positioning of the hammer member 4 and cutting member 7 allows the blades 27 and hammers 5 of the hammer member 4 to interweave with the blades 8 of the cutting member 7. As the waste 2 enters the interweaving engagement of the hammer member 4 and cutting member 7, the waste 2 is simultaneously cut and possibly fragmented by the blades 8 and fragmented by the hammer pins 5.

Each cutting member 7 has a cylindrical periphery 158 with a spacing shaft 156 between the blades 8. Each hammer pin 5 of the hammer member 4 has a length 160 so that its distal end 162 provides a minimal clearance space 164 between the hammer pin 5 and the spacing shaft 156 when the hammer member 4 and cutting member 7 are appropriately oriented, one to the other. This spacing allows the hammer 5 to fragment the waste 2 against the spacing shaft 156 in addition to fragmenting the waste 2 between the wings 150 and 150' of the spacer 148.

The shearing action of the blades 8 is enhanced by two factors. One factor is the hammer member 4 has a plurality of blades 27 in addition to the hammer pins 5. The blades 27 assist in shredding the waste 2. A second factor is that the rotation of the cutting member 7 and hammer member 4 oppose each other at their interweaved tangential interface. This opposing interaction helps shred the waste 2 by tearing it apart.

If caught upon, or propelled by the cutting member 4, the waste 2 travels toward the blade combing member 15. The waste 2 may be fragmented by being thrown against the surfaces of the combing member by the cutting member 7. The combing member 15 has fingers 17. The fingers extend between adjacent blades 18 providing a minimum clearance 99 between the finger 97 and the blades 18. As the cutting member 7 rotates, the fingers 17 impact the accumulated waste 2 between adjacent blades 18 thereby displacing the accumulated waste 2 away from the periphery 9 of the cutting member 7. The combing member 15 extends between the blades 8 for approximately 20 to 30 degrees of rotation in the illustrated embodiment at the back side of the cutting member 7. It is contemplated that the combing member 15 may be configured so that an interference surface is presented to the hammer pins 5 for additional fragmenting.

As the waste 2 passes through the hammer member 4 and cutting member 7, most of the waste 2 reaches the back end 51 of the housing 52. In the embodiment shown in FIG. 3, three fragmenting bars 10 are positioned on the back end 51 of the housing 52. These fragmenting bars 10 are elongated strips extending across the housing 52 and are generally equal to the lengths 16 and 22 of the hammer member 4 and cutting member 7. The bars 10 are connected to the adjustment scroll 11. The scroll 11 allows radial positioning of the bars 10 with respect to a central longitudinal axis 98 of the hammer member 4. As the hammer pins 5 are worn down with use, the scroll 11 can be adjusted by removing bolts and repositioning the scroll 11 closer to the central longitudinal axis 98. The bolts are reattached to the scroll 11 after repositioning. By adjusting the scroll 11, the positioning bars 10 maintain a substantially uniform clearance 12 to allow some waste 2 to pass through while other waste 2 will be fragmented into the bars 10 by the hammer member 4.

As the waste 2 travels to the bottom of the housing 52, some waste 2 will pass through the screen 24 as smaller pieces 3. These pieces 3 will be removed to the bin 58 by the conveyance system 54. The pieces 3 will be unrecognizable with regard to their pre-processed form.

In an alternative embodiment, the hammer pins 5 are not present on the hammer member 4. The screen 24 is moved upward, adjacent to the bottom of the hammer member 4 so that the spinning blades 27 push the waste 2 through the screen 24.

Referring to FIG. 9, the hammer member 4 and cutting member 7 are provided with rotational movement by a motor 25. The motor 25 is connected to a shaft 32. The shaft 32 is in turn connected to the hammer member 4 and to a gear assembly 34. Alternatively, an interconnecting pulley system can be used instead of gears. The cutting member 7 has a shaft 38 which is connected to a gear assembly 36. The gear assembly 34 interlocks with the gear assembly 36. As the motor 25 rotates the shaft 32, the hammer member 4 rotates in conjunction with the cutting member 7 as a result of the shaft 38 being connected with the shaft 32 via gear assemblies 34 and 36.

A 50 horsepower (37,300 watt) motor 25 is generally sufficient to operate the mill 1. The gear assembly 34 is in a one to two ratio with the gear assembly 36. Because the diameter of the hammer member 4 is about two times that of the cutting member 7, the hammer member 4 will spin at approximately 1700 revolutions per minute (rpm) while cutting member 7 will spin at approximately 3600 rpm. This rate of rotation allows the engagement speeds at the peripheries of the hammer member 4 and cutting member 7 to be approximately equal.

By operating the hammer member and cutting member at high speed, the ability of the hammer member 4 and the cutting member 7 to fragment the waste 2 is enhanced. Also the high speeds of rotation increase the number of reducing cycles in a given period of time. Additionally, the added momentum helps prevent the hammer member 4 and cutting member 7 from bogging down when filled with the waste 2.

A fragmenting and shredding system and its components have been described herein. These and other variations, which will be appreciated by those skilled in the art, are within the intended scope of this invention as claimed below. As previously stated, detailed embodiments of the present invention are disclosed herein; however, it is to be understood that the disclosed embodiments are merely exemplary of the invention that may be embodied in various forms.

What is claimed and desired to be secured by Letters Patent is as follows:

1. A mill for reducing solid material into smaller pieces; said mill comprising:

a hammer member oriented for rotation in a first direction, said hammer member having a plurality of hammer pins longitudinally and alternately arranged with a plurality of saw-toothed hammer blades, each of said saw-toothed hammer blade having a series of circumferential hammer cutting teeth, each of said hammer cutting teeth oriented to bite forward in said first direction of rotation;

a cutting member oriented for rotation in a second direction opposite to said first direction, said cutting member having a plurality of saw-toothed cutting blades, each of said saw-toothed cutting blades having a series of circumferential cutting teeth, each of said cutting teeth biting forward in said second direction of rotation; and said hammer member being positioned proximate to said cutting member so that solid material processed through said mill is reduced to smaller pieces.

2. The mill for reducing solid material into smaller pieces as recited in claim 1; further comprising:

said hammer member having a longitudinal axis about which said hammer member rotates;

said cutting member having a longitudinal axis about which said cutting member rotates;

said hammer member and said cutting member each having substantially cylindrical peripheries, said peripheries each comprising a plurality of circumferentially aligned ridges and recesses;

said longitudinal axis of said hammer member being parallelly oriented to said longitudinal axis of said cutting member and distanced therefrom so that said peripheries overlap and said ridges of said hammer member interweave with said recesses of said cutting member and said ridges of said cutting member interweave with said recesses of said hammer member;

each of said hammer cutting teeth having a radial recess at a distal end thereof and a plurality of said radial recesses on a saw-toothed hammer blade being circumferentially aligned about said hammer member thereby forming an intermittent groove at a periphery of said saw-toothed hammer blade; and a peripheral portion of a saw-toothed cutting blade being operatively positioned within said intermittent groove in said saw-toothed hammer blade.

3. The mill for reducing solid material into smaller pieces as recited in claim 2; wherein said ridges and said recesses interweave with narrow clearances therebetween so that brittle pieces of solid material positioned across said narrow clearances are fragmented by opposed relative motion of said hammer member and said cutting member at said interweaved peripheries.

4. The mill for reducing solid material into smaller pieces as recited in claim 2, further comprising:

at least one fragmenting bar positioned proximate to said hammer member so that solid material projected from said hammer member is further fragmented upon striking said fragmenting bar; and said fragmenting bar being coupled to an adjustment scroll for maintaining a substantially uniform clearance between said fragmenting bar and said hammer member.

5. The mill for reducing solid material into smaller pieces as recited in claim 2; further comprising:

a hopper positioned proximate to said hammer member for directing solid material into said periphery of said hammer member.

6. The mill for reducing solid material into smaller pieces as recited in claim 2; further comprising:

said cutting member having a rotational axis; and a blade combing member positioned substantially parallel to said rotational axis of said cutting member for sweeping solid material from said cutting member.

7. The mill for reducing solid material into smaller pieces as recited in claim 6; further comprising:

said blades being regularly spaced along a length of said cutting member; and said blade combing member having a plurality of fingers wherein at least a portion of said fingers being positioned between adjacent blades.

8. The mill for reducing solid material into smaller pieces as recited in claim 2; further comprising:

said hammer pins being regularly spaced to form generally circumferential rows of hammer pins around said hammer member; and said generally circumferential rows being regularly spaced along a length of said hammer member.

9. The mill for reducing solid material into smaller pieces as recited in claim 2; further comprising:

a screen being positioned proximate to said hammer member for selectively permitting solid waste to be dispensed from said mill.

10. The mill for reducing solid material into smaller pieces as recited in claim 2; further comprising:

a motor engaged with said cutting member and said hammer member for rotating both members.

* * * * *